United States Patent [19]

Rossel et al.

[11] 4,054,080

[45] Oct. 18, 1977

[54] TANK EQUIPPED WITH LARGE-CALIBRE FIREARM

[75] Inventors: Karl Ulf Rossel, Granbergsdal; Sven-Håkan Svensson, Karlskoga, both of Sweden

[73] Assignee: AB Bofors, Bofors, Sweden

[21] Appl. No.: 617,260

[22] Filed: Sept. 26, 1975

[30] Foreign Application Priority Data

Oct. 18, 1974 Sweden ..... 7413128

[51] Int. Cl.[2] ..... F41F 23/02; F41F 23/10

[52] U.S. Cl. ..... 89/38; 89/40 B

[58] Field of Search ..... 89/36 H, 36 K, 37.5 D, 89/38, 39, 40 B

[56] References Cited

U.S. PATENT DOCUMENTS

| | | | |
|---|---|---|---|
| 46,516 | 2/1865 | Winans | 89/38 |
| 1,120,247 | 12/1914 | Schneider | 89/38 |
| 1,170,577 | 2/1916 | Strauss et al. | 89/38 |
| 1,481,469 | 1/1924 | Krammer | 89/37.5 D |
| 3,401,598 | 9/1968 | Sons | 89/40 B |

FOREIGN PATENT DOCUMENTS

| | | | |
|---|---|---|---|
| 1,428,747 | 7/1969 | Germany | 89/40 B |
| 736,555 | 6/1943 | Germany | 89/37.5 D |

*Primary Examiner*—Stephen C. Bentley

*Attorney, Agent, or Firm*—Pollock, Vande Sande & Priddy

[57] ABSTRACT

An improved mounting apparatus for high-calibre guns, for use on mobile platforms such as tanks, includes a support for the gun which permits the elevation trunnions to be moved vertically from a lowered, small silhouette position to a raised position which permits optimum movement in train and elevation.

7 Claims, 7 Drawing Figures

TANK EQUIPPED WITH LARGE-CALIBRE FIREARM

BACKGROUND OF THE INVENTION

The present invention relates to a tank equipped with a large-calibre firearm supported by members affixed to the tank chassis. For example, high-pressure guns with calibres of 105 mm may be used in accordance with the invention. For tanks of this kind, it is highly desirable that the firearm can be given a high position on the tank which permits both a wide range of fire around the entire tank and a large angle of depression. The high placement of the gun, however, is contrary to fundamentally requirement of tank design; that is a low tank silhouette which makes it a poor target for enemy fire.

SUMMARY OF THE INVENTION

The present invention relates to a tank in which the previously described, seemingly mutually exclusive requirements, are fulfilled in a distinctive way. In a tank according to the invention, the supporting members for the entire recoiling system of the firearm comprise a unit supporting the firearm which can be moved in relation to the chassis between different vertical vertically spaced positions. Since the firearm, is arranged in the tank chassis so that it can be raised and lowered, it can be given the vertical position desired during filing. On the other hand with the weapon lowered, the tank can present a low silhouette to an enemy.

BRIEF DESCRIPTION OF THE DRAWING

The invention will be described with reference to the accompanying drawings, in which.

DETAILED DESCRIPTION OF THE PREFERRED EMBODIMENTS

In the Figures, parts corresponding to each other have been given the same reference designations.

Figure 1:
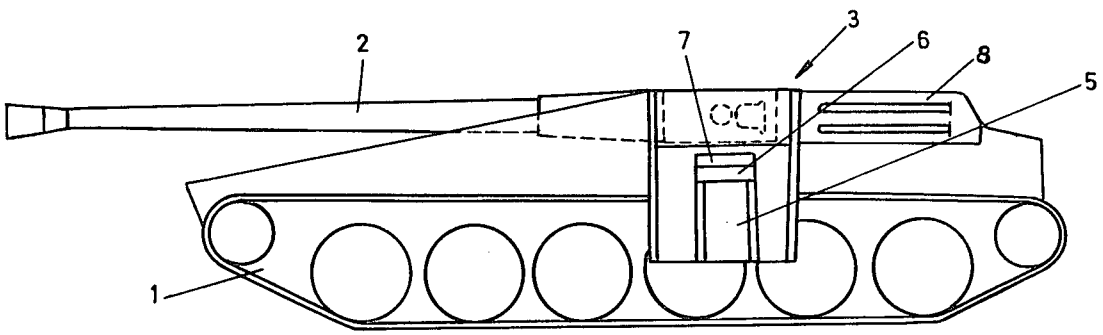
FIG. 1 in a vertical view and in a first functioning stage shows a first embodiment of a tank utilizing the invention.
Figure 2:
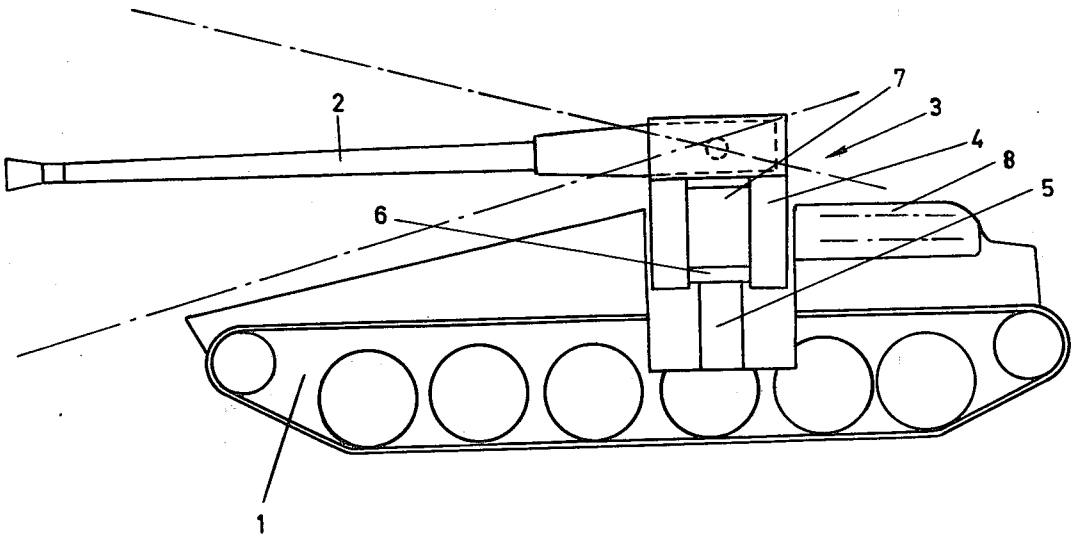
FIG. 2 in a vertical view and in a second functioning stage shows the tank according to FIG. 1.

In FIGS. 1 and 2, a tank 1 is shown having a gun or firearm with a barrel 2. The entire recoiling system of the firearm is arranged in supporting members 3 intended for this purpose, which can be regulated so that the firearm can be raised and lowered in relation to the tank chassis. FIG. 1 shows the case of the lowered firearm; and FIG. 2, the case of the raised firearm. In the position according to FIG. 2, a wide angle of fire is obtained, among other things due to the fact that the barrel can be depressed to a large angle, as illustrated by a dashed line. In the raised position shown in FIG. 2 the firearm can also be traversed in relation to the tank chassis. Supporting members 3 comprise a unit 4 supporting the firearm, which can be moved between different vertically spaced positions. In the embodiment according to FIGS. 1 and 2, this movement is achieved by means of a piston rod 5 fixed in the tank chassis, the piston 6 of which is located in a cylinder 7 mounted in unit 4. In this embodiment the raising and lowering system is hydraulic, and the ordinary hydraulic system of the tank (not shown) can then be utilized as a source of power. In order to provide for traversing, either the recoiling system can be arranged rotatably on supporting unit 4 or unit 4 itself can be arranged to be rotatable. FIGS. 1 and 2 also show a magazine 8, which extends along the major portion of the width of the tank. Loading of the firearm with rounds in the magazine can take place with the weapon lowered in its rest position by means of known transport devices such as a pendulum or a hoist and a rammer (not shown). However, the invention also encompasses embodiments in which loading takes place with the weapon in its firing position as shown in FIG. 2. In the latter case, the loading can take place with a known pendulum or hoist and rammer.

Figure 3:
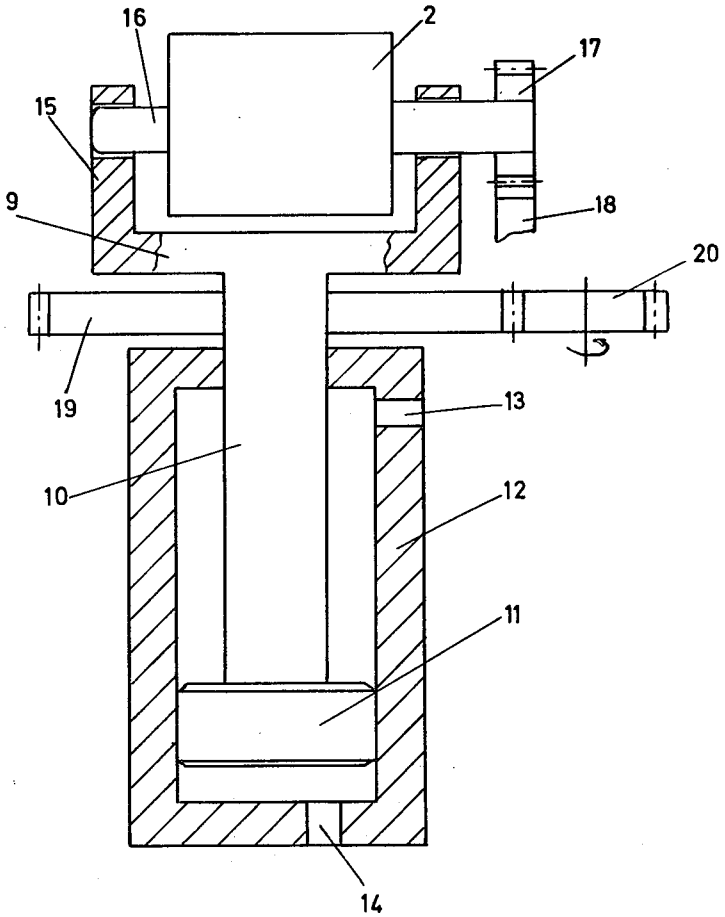
FIG. 3 in a vertical view and partly in cross-section shows a second embodiment of the supporting members for the firearm on the tank.

FIG. 3 is intended to show an example of where the unit 9 supporting the firearm is fastened to a piston rod 10, the piston 11 of which is arranged in a cylinder 12 fixed to the tank chassis. Said cylinder is made with two connection holes 13 and 14 for connecting it to the hydraulic system. The regulation of the piston can be carried out in a way which is known in itself.

The supporting unit is made with a cradle part 15, in which the barrel 2 is supported conventionally in trunnions 16, that barrel 2 can be elevated. In the case shown, elevation is achieved by means of a gear 17 fastened to one of trunnions 16, which is driven via a pinion 18, partly shown, from the elevating system of the tank. Fixed to the piston rod 10 there is a gear 19, which can be actuated via a pinion 20 from the traversing system of the tank. Said members for traversing and elevation follow the vertical movements of the piston rod.

Figure 4:
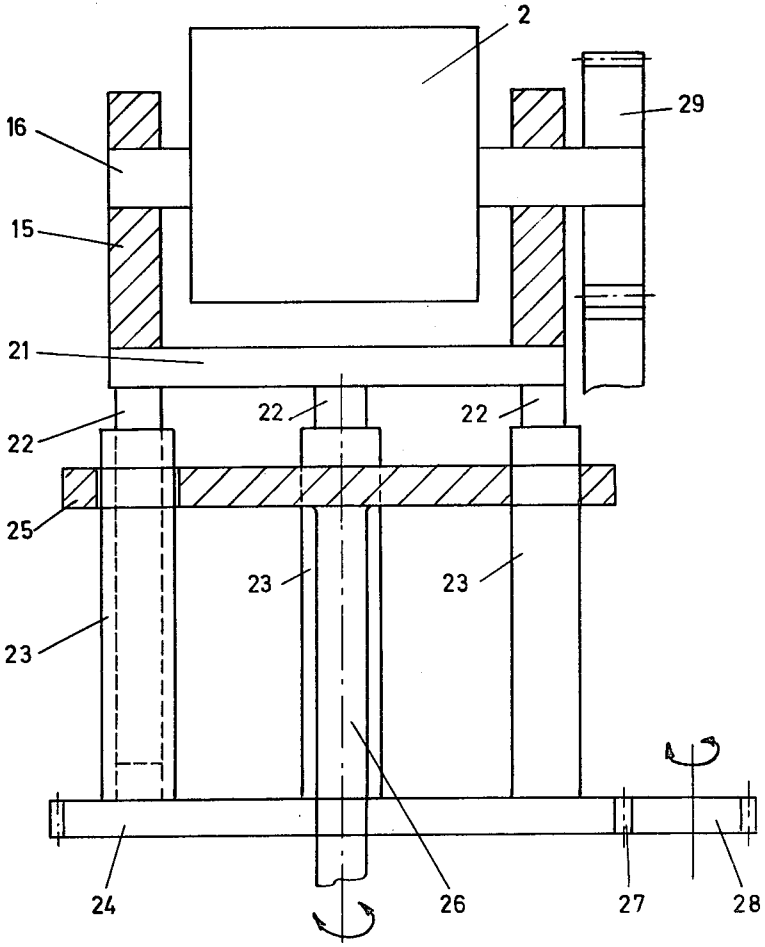
FIG. 4 in a vertical view and partly in cross-section shows a third embodiment of the supporting members for the firearm.

FIG. 4 shows a case where the supporting unit 21 is fastened to the pistons 22 of vertically arranged hydraulic cylinders 23. Cylinders 23 are parts of a device comprising a lower, circular gear plate 24 and an upper, circular support plate 25. Cylinders 23 are fastened to gear plate, 24 on its upper surface. Cylinders 23 extend through openings in support plate 25, to which they are also fixed, so that the plates 24, 25 and cylinders 23 constitute a rigid unit. Said device also comprises a supporting shaft 26, on which the device is rotatably supported in the tank chassis. The device is rotatable from the traversing system of the tank via a gear ring 27 mounted on gear plate 24 and a drive pinion 28. Supporting shaft 26 is located in the centre of the device, while hydraulic cylinders 23 are spaced equally around the periphery of plates 24 and 25. In the case shown, there are 4 cylinders. The supporting unit supports a cradle part 15, in which the barrel is supported in the trunnions 16. The barrel can be elevated from the elevating system of the tank by means of among other things, the gear 29.

Figure 5:
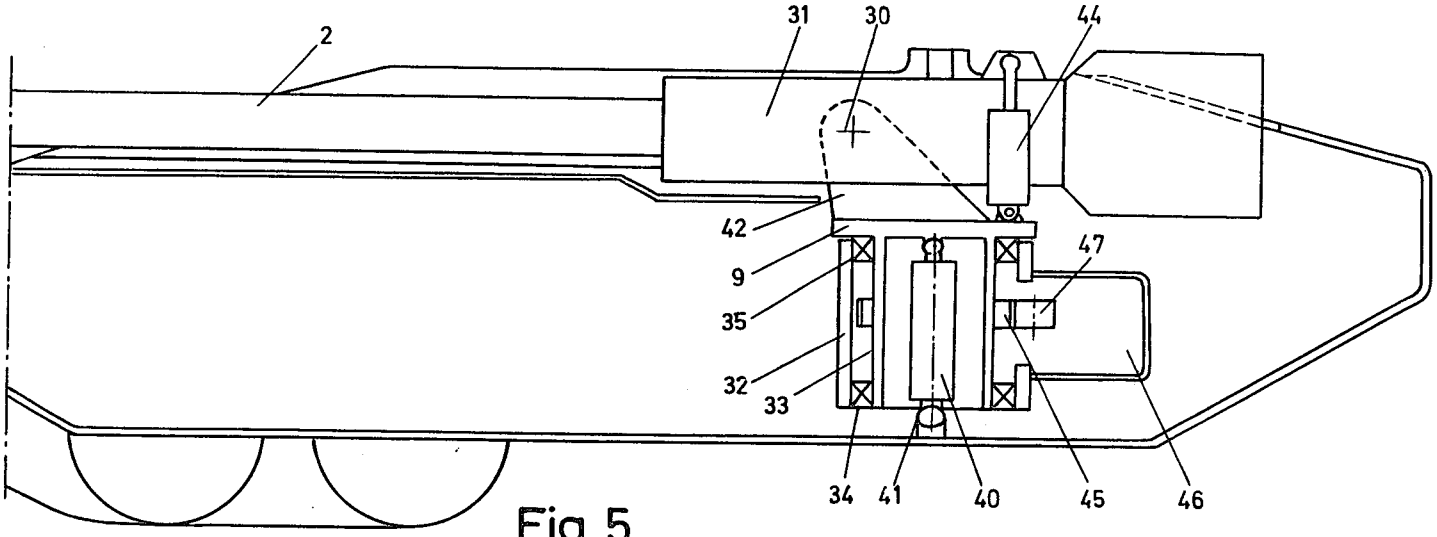
FIG. 5 in a vertical view shows a tank that differs from the tank according to FIGS. 1 and 2 with a fourth embodiment of the supporting members for the firearm.
Figure 6:
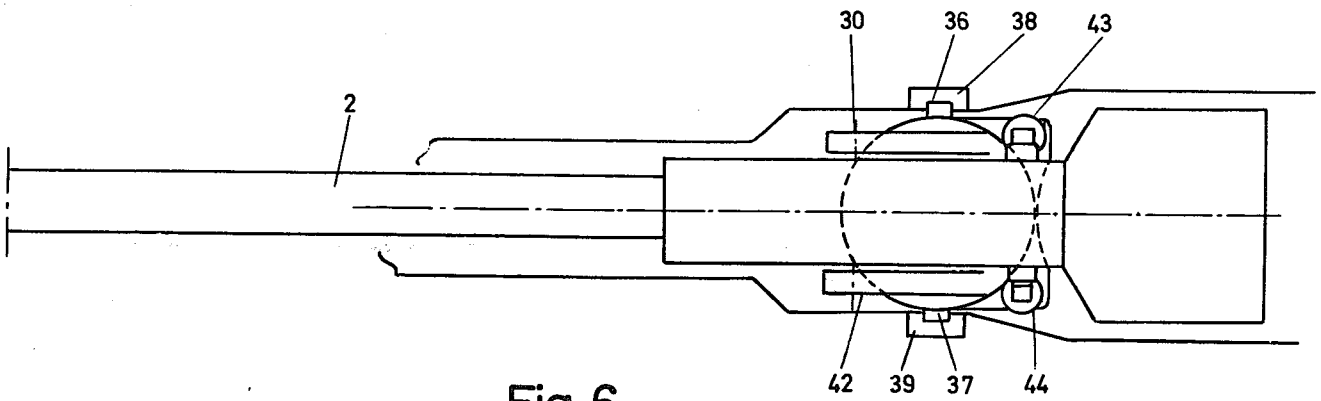
FIG. 6 in a horizontal view shows the relevant parts of the tank according to FIG. 5.
Figure 7:
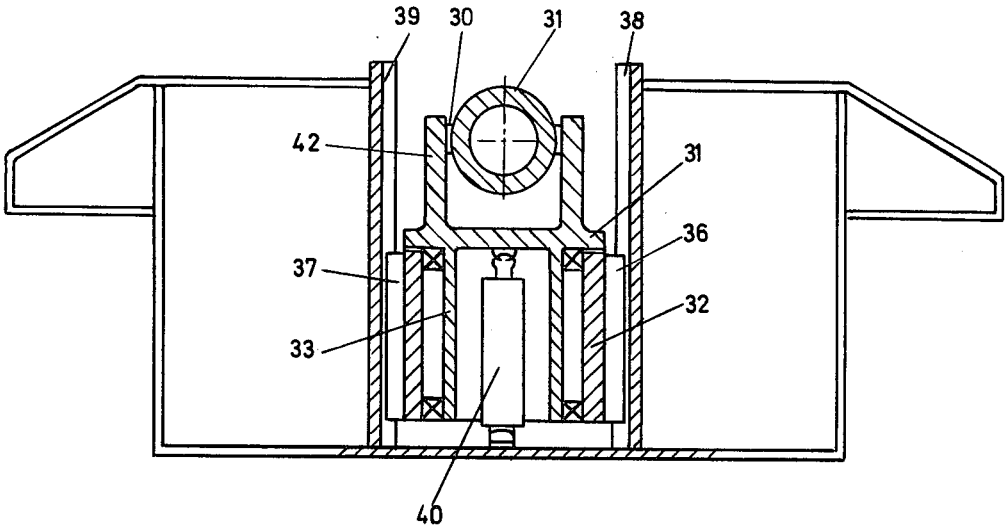
FIG. 7 in a vertical view and in cross-section shows the relevant parts of the tank according to FIG. 5, but turned 90°.

FIGS. 5–7 show another embodiment of the tank, as well as a further embodiment of the supporting members for the firearm which, according to the figures, is supported on trunnions 30 in the recoil jacket 31. In this case, the unit 9 supporting the firearm is fastened in a device with an outer cylinder 32 and an inner cylinder 33, which is rotatably supported in the outer cylinder via ball bearings 34 and 35, but is fixed to the cylinder in the axial direction. Outer cylinder 32 is arranged so that it can be displaced vertically on vertical guides 36 and 37, which are guided in grooves in parts 38 and 39, respectively, fixed to the chassis. Inside the inner cylinder, a hydraulic cylinder 40 is arranged, which has one end fastened to the underside of the unit 9 supporting the firearm, and has its other end arranged in the tank chassis at a point 41. When the hydraulic cylinder is activated, the inner cylinder with the supporting unit is thus pressed up together with the outer cylinder, which is guided via guides 36 and 37.

Also in this case the firearm is arranged so that it can be elevated in the cradle part 42 by means of two further hydraulic cylinders 43 and 44, which are fastened to the upper side of supporting unit 9 and to the firearm. Inner cylinder 33 and, the supporting unit 9, are rotatably arranged by means of a gear 45 mounted on the outside of inner cylinder 33 which can be actuated from the traversing system via further transmission elements such as pinion 47 arranged in a housing 46 which rides with cylinder 33. In order to be able to follow the rotating movement, the hydraulic cylinder 40 is fastened at the fastening point 41 to the chassis by means of a rotatable support of a kind which is known in itself.

The invention is not limited to the embodiments shown above as examples, but can be subject to modifications within the scope of the following claims.

We claim:

1. A tank equipped with a large-calibre gun, said tank havng a chassis, comprising:

hydraulic cylinder means mounted in said chassis for vertical expansion relative thereto;

means for supporting said gun for elevation about a horizontal axis, said supporting means being attached to said hydraulic cylinder means for movement in response to expansion thereof;

first support cylinder means surrounding said hydraulic cylinder means and depending from said supporting means;

second support cylinder means surrounding said first support cylinder means, said second cylinder means being adapted to permit said first support cylinder means to rotate therewithin;

means for rotating said first support cylinder means within said second support cylinder means; and means for preventing rotation of said second support cylinder while permitting vertical movement thereof.

2. A tank according to claim 1, further comprising bearings arranged between said first and second support cylinder means.

3. A tank according to claim 1, wherein said hydraulic cylinder means is fastened to said chassis by a rotatable support, whereby said hydraulic cylinder means may rotate with said first support cylinder means.

4. A tank according to claim 1, wherein said rotating means is attached to said second support cylinder means.

5. A tank according to claim 1, wherein said preventing means comprises cooperating vertical guides between said second support cylinder and said chassis.

6. A tank according to claim 3, wherein said preventing means comprises cooperating vertical guides between said second support cylinder and said chassis.

7. A tank according to claim 4, wherein said preventing means comprises cooperating vertical guides between said second support cylinder and said chassis.

* * * * *